United States Patent [19]

Hennessey

[11] Patent Number: 4,852,448

[45] Date of Patent: Aug. 1, 1989

[54] BILATERAL TREMOLO APPARATUS

[76] Inventor: James R. Hennessey, 7 Sunrise Hill Dr., West Hartford, Conn. 06107

[21] Appl. No.: 187,957

[22] Filed: Apr. 29, 1988

[51] Int. Cl.[4] ..... G10D 3/04

[52] U.S. Cl. ..... 84/313

[58] Field of Search ..... 84/313

[56] References Cited

U.S. PATENT DOCUMENTS

| | | | |
|---|---|---|---|
| 2,136,627 | 11/1938 | Lohman | 84/313 |
| 2,889,732 | 6/1959 | Juricek | 84/312 |
| 3,181,409 | 5/1965 | Burns et al. | 84/313 |
| 3,185,011 | 5/1965 | Anderson | 84/313 |
| 3,382,749 | 5/1968 | Watson | 84/313 |
| 3,512,443 | 5/1970 | Parson et al. | 84/313 |
| 3,686,993 | 8/1972 | Fender | 84/312 R |
| 3,910,152 | 10/1975 | Kusakawa | 84/307 |
| 4,044,645 | 8/1977 | Franzmann | 84/313 |
| 4,100,832 | 7/1978 | Peterson | 84/313 |
| 4,126,074 | 11/1978 | Lundquist | 84/313 |
| 4,137,812 | 6/1979 | Franzmann | 84/313 |
| 4,343,220 | 8/1982 | Lundquist | 84/313 |
| 4,354,417 | 10/1982 | Glaser, II | 84/312 R |
| 4,397,212 | 8/1983 | Carson | 84/313 |
| 4,535,670 | 8/1985 | Borisoff | 84/312 R |
| 4,658,693 | 4/1987 | Hennessey | 84/313 |
| 4,782,732 | 11/1988 | Kato et al. | 84/313 |

FOREIGN PATENT DOCUMENTS

| | | | |
|---|---|---|---|
| 3241849 | 5/1984 | Fed. Rep. of Germany | 84/313 |
| 59171756 | 6/1986 | Japan . | |

*Primary Examiner*—Lawrence R. Franklin

*Attorney, Agent, or Firm*—Ira S. Dorman

[57] ABSTRACT

A device for dynamically varying the pitch of a stringed musical instrument employs a positioning lever on the front of the instrument body for adjusting the amount of extension of an operating lever disposed to the rear thereof. Both levers may be employed for producing string pitch variation, and a worm gear assembly is desirably employed for transmitting rotary motion of the positioning lever to pivotal movement of the operating lever.

26 Claims, 3 Drawing Sheets

BILATERAL TREMOLO APPARATUS

BACKGROUND OF THE INVENTION

Electric guitars are often fitted with mechanisms for dynamically changing the tension upon one or more of the sound-producing strings, so as to vary the pitch. By using such a mechanism to alternately change tension on the strings, a so-called "tremolo" effect can be produced; reducing the tension from the as-tuned condition results in what is known as a "choking" effect; "not bending" and "detuning" effects can be produced as well with mechanisms of this type.

In their most conventional form, tremolo devices employ a lever which is pivotably mounted on the bridge block, at a location adjacent the bass E-string of a guitar (i.e., nearer the lower edge of the instrument body in normal playing position), and is disposed to the front of the body near its tail or bottom end; thus, it is positioned for oscillation by the player using his picking and strumming hand. The produce the desired effect, the performer must therefore first play a note or chord, and then move his hand to operate the tremolo lever or bar; he cannot readily do both at the same time.

Variations in the means for operating pitch varying mechanisms of this type have been proposed in the art. For example, in Glaser, II U.S. Pat. No. 4,354,417, a tone changer unit is disclosed wherein individual strings may be attached to one of three lever arms to enable alteration of their pitch. An extension arm is non-rotatably connected to one of the three lever arms, and is designed to be operated by engagement with the performer's body. The unit is located at the top of the instrument body near the neck junction, and cables are employed to transmit movement of the operating lever assembly to the bridge assembly, and thereby to the strings of the instrument.

A note bender attachment is shown in Borisoff U.S. Pat. No. 4,535,670, which is actuated by body movements through contact with an arm that extends rearwardly from the tail end of the instrument. The actuating arm is evidently disposed to lie alongside of the player's hip when the instrument is held in playing position.

Other United States patents show pitch changing devices for stringed instruments which are actuated in various ways. Thus, Lohman U.S. Pat. No. 2,136,627 uses an electric motor to vibrate the bridge of a guitar, and U.S. Pat. No. 3,382,749 to Watson discloses the similar use of the pneumatic diaphragm. A pedal-operated tuning control arrangement, which is connected from the rear of the instrument, is shown in Jurichek U.S. Pat. No. 2,889,732, and strap-control mechanisms are disclosed both in Parson et al U.S. Pat. No. 3,512,443 and in Fender U.S. Pat. No. 3,686,993.

Kusakawa U.S. Pat. No. 3,910,152 provides a sliding bridge for a stringed instrument, the position of which may be adjusted by pedals connected through the rear of the body. Lundquist U.S. Pat. No. 4,343,220 utilizes the chin rest of a violin, or a chest or hand-operated plunger arrangement, to produce vibrato by oscillation of the bridge, and an external frame is described by Carson in U.S. Pat. No. 4,397,212 for producing vibrator and pitch control in a guitar.

Although the prior art therefore discloses different forms of hand-held stringed musical instruments having dynamic pitch changing mechanisms, which are operated by movement of the instrument relative to the player's body, still the arrangements disclosed are not optimal. The performing styles of modern guitarists are often typified by wide-ranging and vigorous movement, and may be inhibited to the extent that such action is dictated by the need to maintain the operating member, of a pitch-controlling mechanism for the instrument, in a certain position. The musical, as well as the visual, quality of the performance may be significantly affected as a result.

Hennessey U.S. Pat. No. 4,658,693 provides apparatus for dynamic pitch variation in a hand-held stringed musical instrument, and an instrument incorporating such apparatus, which permits the performer to effectively control the character of the sound produced while, at the same time, affording him a wide range of movement. This is achieved by pivotably attaching an operating arm to the bridge block, in such a manner as to dispose the arm along the rear face of the body of the instrument.

Despite the highly effective and desirable nature of the device of the Hennessey patent, a demand remains for a pivotable bridge block assembly in which a rear-mounted operating arm can be extended and retracted from the front of the instrument, so as to permit the player to quickly, easily and selectively condition for use, or effectively disable, the pivot-actuating structure. It is important moreover, that the device be so designed that the instrument can be rested against the performer's body, with the bridge-pivoting arm in its operative condition, without causing inadvertent shifting the block and thereby unwanted pitch changes.

Accordingly, it is the broad object of the present invention to provide a novel mechanism for a pivotable, musical instrument bridge block, wherein a rear mounted operating lever, used for pivoting of the block, can be moved between relatively operative and inoperative positions by manipulation of positioning means accessible at the front of the instrument.

Related objects are to provide a bridge block assembly, and a musical instrument, incorporating such a mechanism.

More specific objects of the invention are to provide a mechanism and assembly having the foregoing features and advantages, wherein the means provided for coupling the operating lever to the positioning means is particularly adapted for permitting rapid extension and retraction of the operating arm while, at the same time, positively affixing the arm in any selected position throughout its range of movement, and to provide an operating arm which is itself of variable orientation.

Another broad object of the invention is to provide a musical instrument having a rear-operated pivotable bridge block, in which the operating lever is so constructed and mounted that the instrument can be rested upon the performer's body without causing inadvertent changes of string pitch.

Further objects are to provide such a mechanism and assembly which are of relatively simple and inexpensive construction, which may readily be fitted to a musical instrument either as original equipment or as an add-on feature, for after-market installation, and which present a tremolo-producing lever on the front of the instrument, near the edge of the body that is upwardly disposed in normal playing position.

SUMMARY OF THE INVENTION

It has now been found that certain of the foregoing and related objects of the invention are attained by the provision of a novel bridge block assembly for a musical instrument. The assembly includes a bridge block with opposite end portions, one of which portions has means thereon for attaching at least one string, the block having means thereon for pivotally mounting it to enable shifting of the opposite end portions relative to one another. A first lever is mounted proximate the "one" end portion, so to enable it to effect pivotal movement of the bridge block, and for movement relative thereto between first and second positions. A second lever is mounted proximate the opposite end portion, also for effecting pivotal movement and for movement relative to the block between first and second positions. Coupling means operatively interconnects the first and second levers in such a way that movement of the second lever can be effected by movement of the first, between the "first" and "second" positions thereof, respectively.

Generally, the "first" lever will comprise a portion that is mounted for pivotal movement on a first axis which extends between the end portions of the bridge block, and will include an operating portion disposed outwardly of the "one" end portion of the block. The "second" lever will also comprise a portion mounted on the bridge block for pivotal movement, on a second axis that is oriented transversely to the first, and will include an operating portion disposed outwardly of the opposite end portion of the block.

In preferred embodiments, the coupling means will comprise a worm gear, including a worm and a wheel attached, respectively, to each of the two levers. The mounted portion of the first lever will comprise a shaft element pivotably mounted on the "one" end portion of the bridge block and having the worm attached to it, and the operating portion thereof will comprise an arm element extending laterally from the shaft element. Similarly, the mounted portion of the second lever will comprise a shaft element extending along the "second" axis, and having the wheel of the worm gear attached to it; the operating portion thereof will also comprise an arm element. The arm element of the first lever will be movable to pivot its shaft element through a first angle having a value of 30° to 360°, the worm: wheel turning ratio being such that the "first" and "second" positions of the arm element of the second lever thereby attained will be displaced from one another by a second angle having a value of 30° to 90°; in a typical specific case, those angular values will be about 180° and 30°, respectively. Normally, the operating arm will lie against the rear face of the instrument body in its fully retracted position.

The shaft and arm elements of the second lever will desirably be joined to one another through a generally L-shaped section, comprised of a first leg extending from the shaft element in a direction away from the axis of pivoting of the first lever, and a second leg extending between the first leg and the arm element, along an axis that is generally parallel to the axis of pivoting of the second lever. These axes will most desirably be parallel to the axis of pivoting of the bridge block, and the plane in which they lie will be intersected, at a location between them, by a plane projected normal to the common plane and including the bridge block pivotal axis. The second leg of the L-shaped section will advantageously be comprised of two elements, interengageable with one another in each of a multiplicity of relative angular orientations.

Other objects of the invention are attained by the provision of a mechanism for pivoting a musical instrument bridge block, comprised of first and second levers and coupling means operatively interconnecting them, each as herein described. Further objects are attained in a stringed musical instrument, including an instrument body and bridge means comprised of the pivotable bridge block assembly, as also described.

Yet additional objects are attained by the provision of a stringed musical instrument having a body and pivotable bridge means, and including an operating arm adapted to conform generally to contours of the human body trunk. Mounting means attaches the operating arm to the bridge block at a location offset from a plane, taken transversely through the instrument body, in which the axis of pivoting of the bridge block lies so that, if force were applied at that location, in a plane parallel to the transverse plane, it would tend to pivot the block. The mounting means also disposes the arm, in its operative position, at an acute angle to and passing through the plane of the rear face of the instrument body, with portions extending inwardly and outwardly thereof. The point of intersection of the operating arm with the plane of the rear face lies generally in the transverse plane.

Thus, with a trunk part of the player's body seated in the crotch formed between the instrument body and the operating arm, in the region of the intersection therebetween, the player can produce string pitch variation by such relative movement of his body and the instrument as will shift the operating arm, and thereby cause the bridge block to pivot. Force applied by the player's body in a direction generally normal to the rear face of the instrument will not, however, tend to cause pivoting of the bridge block to occur. As a result, the instrument can be allowed to rest upon the player's body with little concern that unwanted pitch changes will occur.

The instrument may additionally include a third lever, proximate the "one" end portion of the bridge block, for effecting pivotal movement thereof (i.e., the conventional tremolo bar). Also, a slightly protruding element of compressible material may be affixed to the rear face of the instrument body, so as to serve a locating function which will aid the player in optimally positioning the instrument for operating the rear lever.

DETAILED DESCRIPTION OF THE PREFERRED AND ILLUSTRATED EMBODIMENT

Figure 1:
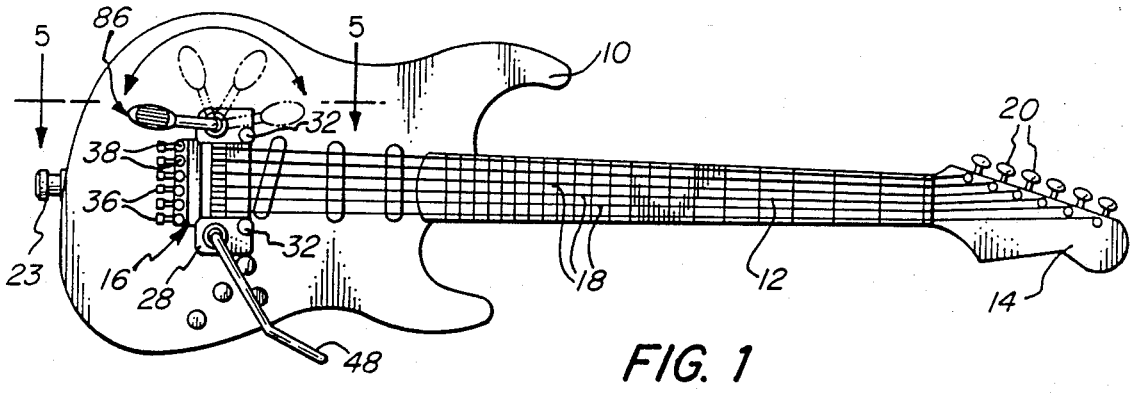
FIG. 1 is a front view of an electric guitar embodying the present invention, having the unique bridge block assembly hereof incorporated thereinto.
Figure 2:
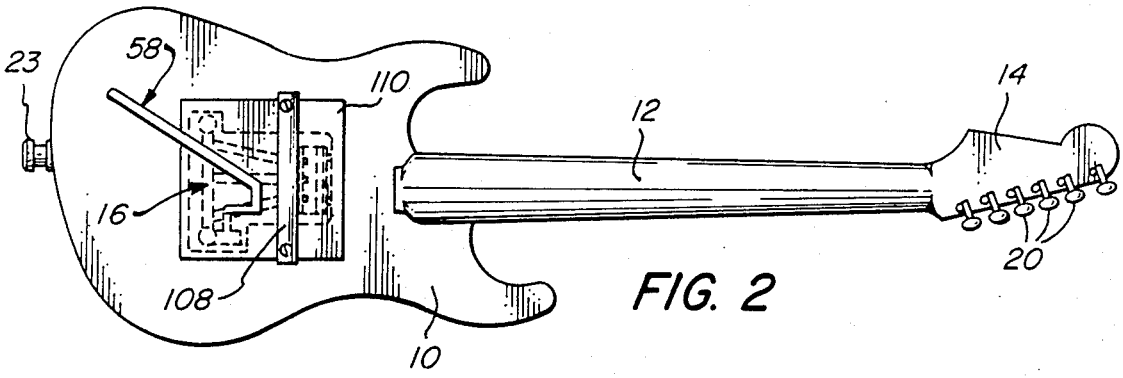
FIG. 2 is a rear view of the guitar.
Figure 3:
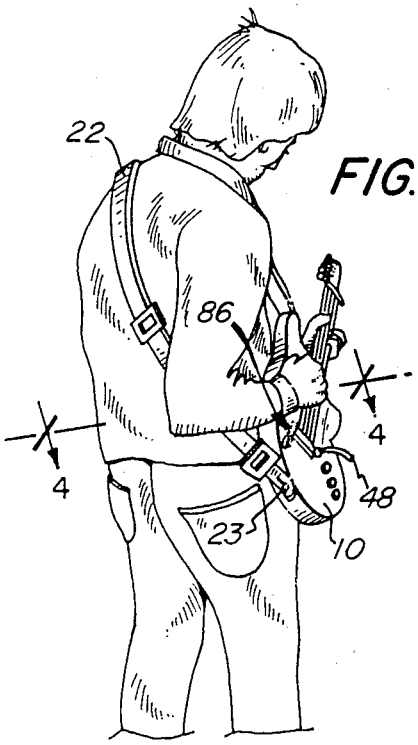
FIG. 3 is a perspective view showing the instrument held by a performer in position for playing.

Turning now in detail to FIGS. 1–4 of the appended drawings, therein illustrated is an electric guitar embodying the present invention and including a body 10 and a neck 12, the neck being attached at one end to the body 10 and having a head portion 14 at its opposite end; a bridge block, generally designated by the numeral 16, is mounted within the body 10. The instrument is strung with six strings 18 (from bass-E at the top, to treble-E at the bottom), the upper ends of which are attached to standard tuning pegs 20 (in the embodiment shown) mounted within the head portion 14, the lower ends being affixed to the bridge block 16 in conventional fashion. A strap 22 may be attached to the body 10 by engagement on the lug 23, to support the guitar over the shoulder of the performer, as shown in FIG. 3.

Figure 5:
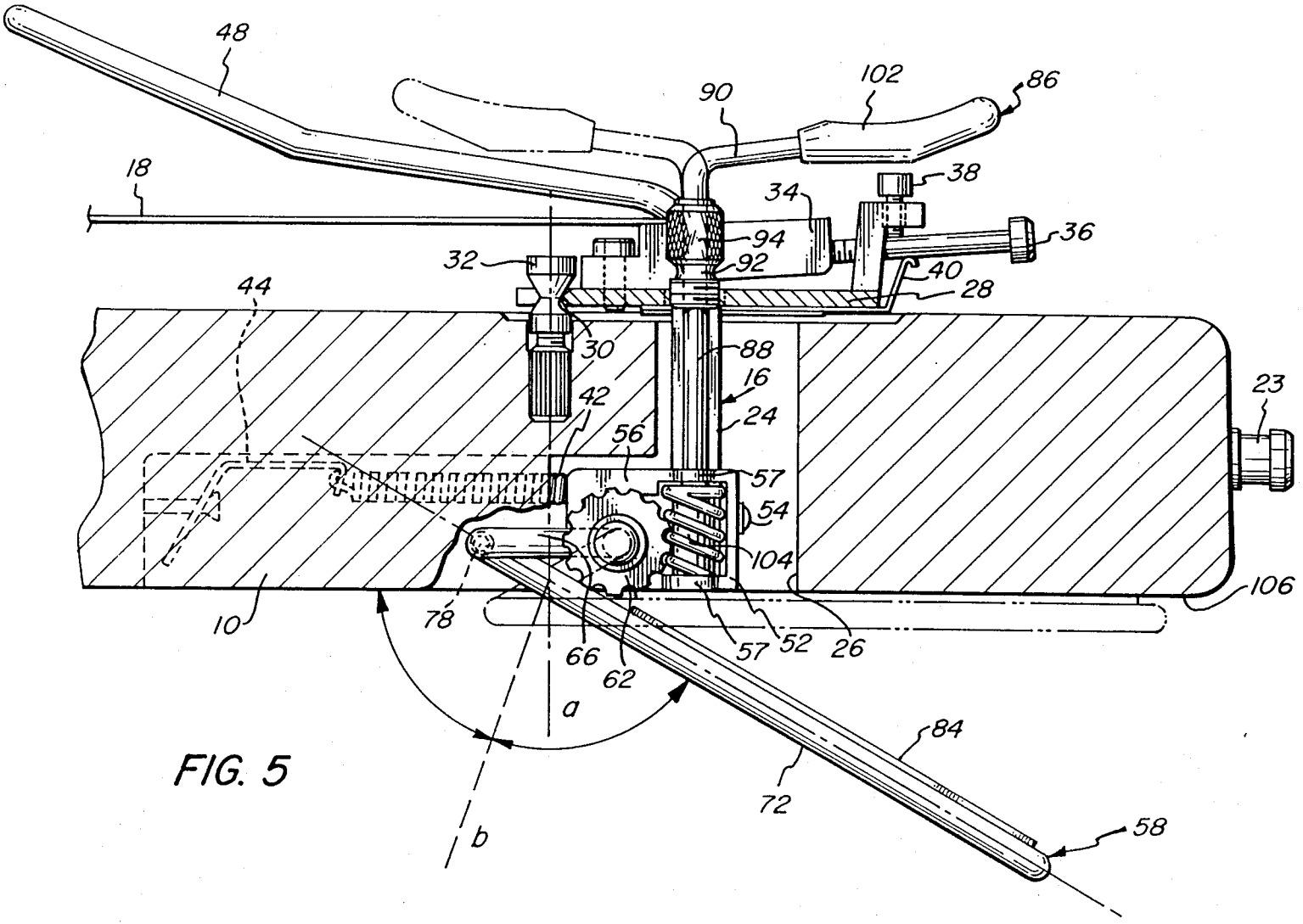
FIG. 5 is a fragmentary sectional view of the instrument, taken along line 5—5 of FIG. 1 and drawn to a scale enlarged therefrom, the Figure showing details of construction of the pitch varying assembly and also showing, in full and phantom line, alternative positions of the positioning and operating levers.
Figure 8:
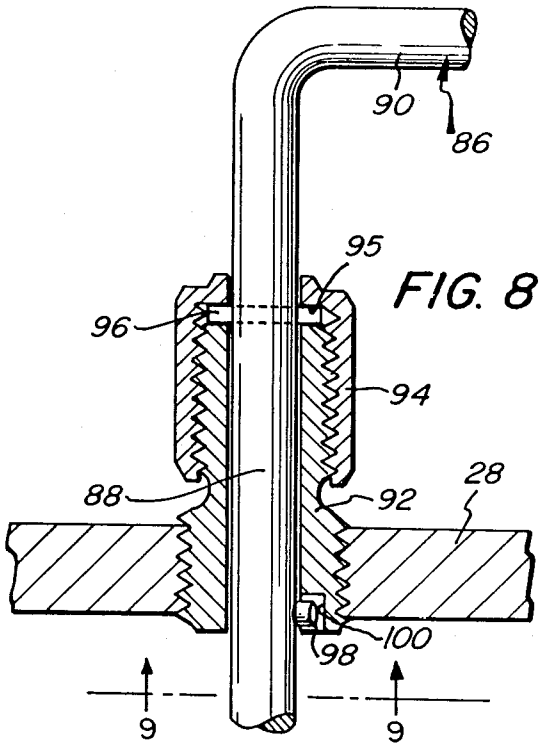
FIG. 8 is a sectional view of the positioning lever and associated mounting structure, taken approximately along line 5—5 is FIG. 1, and drawn to an enlarged scale, with elements of the mounting structure shown in section to expose internal features.
Figure 9:
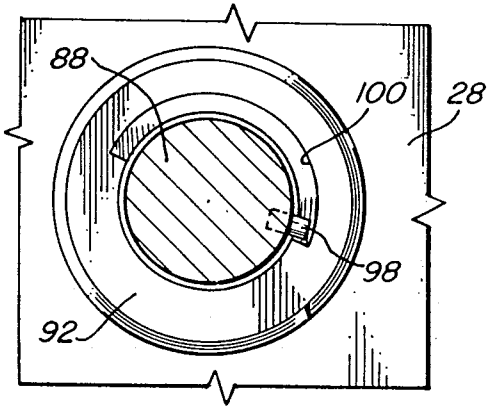
FIG. 9 is a sectional view of the subassembly of FIG. 8, taken along line 9—9 thereof and drawn to a scale greatly enlarged therefrom.
Figure 6:
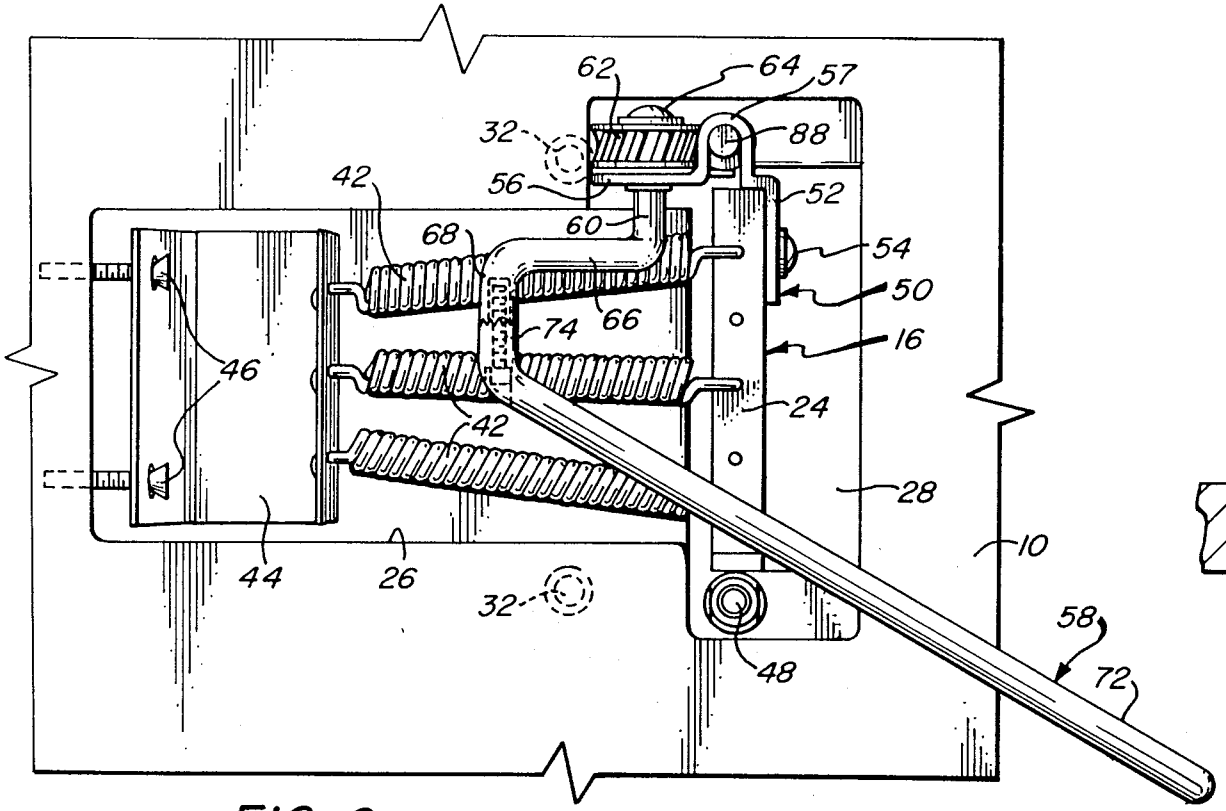
FIG. 6 is a fragmentary rear view of a portion of the instrument, drawn to scale enlarged from that of FIG. 2, with the covering plate and locating bumper, illustrated therein, removed.

The bridge block 16 is illustrated in most detail in FIGS. 5 and 6, and includes a generally rectangular body portion 24 having a depth dimension sufficient to cause the block to extend transversely through the body 10, a compound opening 26 being formed therein to accommodate it. A rigid plate 28 is secured to the top of the bridge body 24, and terminates in a pair of knife edge elements 30, which bear upon circumferentially V-grooved lugs 32 that are permanently set into the guitar body 10, the plate 28 being indented at two locations to receive them; the lugs 32 thus define the axis about which the bridge block 16 pivots.

A set of saddles 34 are mounted upon the plate 28 to hold the lower ends of the strings 18, which are clamped in place by screws 36. A fine tuning screw 38 bears upon each clamping screw 36, to effect slight pivoting of the associated saddle 34 relative to the plate 28, and counteracting leaf spring elements 40 to bear upon the undersides of the clamping screws 36 to urge them upwardly against the associated fine tuning screws 38. Three coil springs 42 (two to five may be employed) are attached at one of their ends to the lower end portion of the block body 24, and at their opposite ends to an anchor plate 44, which is affixed to the body 10 of the instrument by a pair of screws 46. A tremolo bar 48 is pivotably mounted on the bridge block plate 28, on the treble E-string side. Each of the foregoing features is conventional for a guitar having tremolo capability.

A mounting bracket, generally designated by the numeral 50, is affixed adjacent the lower end of the bridge body 24. It is of generally right-angular configuration, and includes a first flange portion 52, which is formed with a shoulder to snugly engage the rear and one side edge of the block body 24; the bracket 50 is secured thereagainst by use of appropriate fasteners, such as screw 54. It also includes a perpendicular flange portion 56, with an intermediate section on which are formed a pair of transversely spaced U-shaped ear elements 57.

A rear-mounted operating lever, generally designated by the numeral 58, includes a stub axle or shaft element 60, which is pivotably mounted within an aperture (not visible) formed through the flange portion 56 of the bracket 50. A worm wheel or gear 62 is engaged upon the outer end portion of the shaft element 60, and the parts are secured in place by upsetting or peening the end 64 of the element 60, or by use of a suitable fastener. One leg 66 of an L-shaped connecting segment extends from the shaft element 60; the perpendicular leg is in two sections, each element 68, 74 of which has a serrated end face 70, 76 thereon. The element 74 is joined to an elongated operating arm element 72, which extends at approximately a 120° angle to it; the arm element 72 will usually be about one inch to five inches in length. As will be appreciated, the serrated end faces 70, 76 mesh with one another to permit the arm element 72 to be fixed in each of many angular attitudes, and the cap screw 78 is received in the bore 80 extending axially through the element 74, and is engaged within the threaded bore 82 in the element 68, to secure the assembly. A cushioning strip 84 of elastomeric material extends along most of the length of the arm 72, and the latter is advantageously formed with a longitudinal surface channel to provide secure seating of the strip.

A positioning lever, generally designated by the numeral 86, consists of shaft and arm elements, 88, 90, respectively, disposed at a slightly obtuse angle to one another. The shaft element 88 extends through a mounting fixture 92, which is threadably engaged at its lower end within the plate 28 of the bridge block 16. The upper end of the fixture 92 threadably engages a cap 94, which in turn engages, under its circumferential lip portion 95, a pin 96 that extends transversely through the shaft element 88. A short second pin 98 is affixed within a radial aperture in the element 88, and rides within a semicircular recess 100 formed into the lower end of a fixture 92; thus, the positioning lever 86 is constrained to turn through an arc of 180°. It will be appreciated that the freedom of rotation of the lever 86 is controlled by the degree to which the cap 94 has been turned down to tighten the transverse pin 96 against the end surface of the fixture 92. A handle element 102, having a smoothly recessed surface contour, is molded upon the free end portion of the arm element 90, as best seen in FIG. 5.

The free end portion of the shaft element 88 of the positioning lever 86 fixedly mounts a worm 104. Adjacent segments of the element 88 are received within apertures formed through the ear elements 57 of the mounting bracket 52, which help to maintain the worm 104 in secure engagement with the teeth of the wheel 62, with which it meshes; ideally, the engagement will be free of significant play, but not so tight as to inhibit quick and easy manual operation.

From the foregoing, it will be evident that rotation of the positioning lever 86 will cause the worm 104 to pivot the wheel 62, thereby retracting the arm 72 of the operating lever 58 from the extended position (shown in solid line in FIG. 5), to the retracted (phantom line) position thereof against the rear face 106 of the guitar body 10. The worm 104 serves not only to jack the operating lever 58 between its operative and inoperative positions, as described, but also (because the axes of rotation of the worm and the wheel are perpendicular) to automatically maintain in it any selected attitude, be it at the extremes of movement or intermediate thereof. Thus, the use of the worm gear arrangement constitutes a most important and novel aspect of the invention. The function of the cushioning strip 84 is of course to protect the instrument body against marring due to contact of the arm 72.

Figure 4:
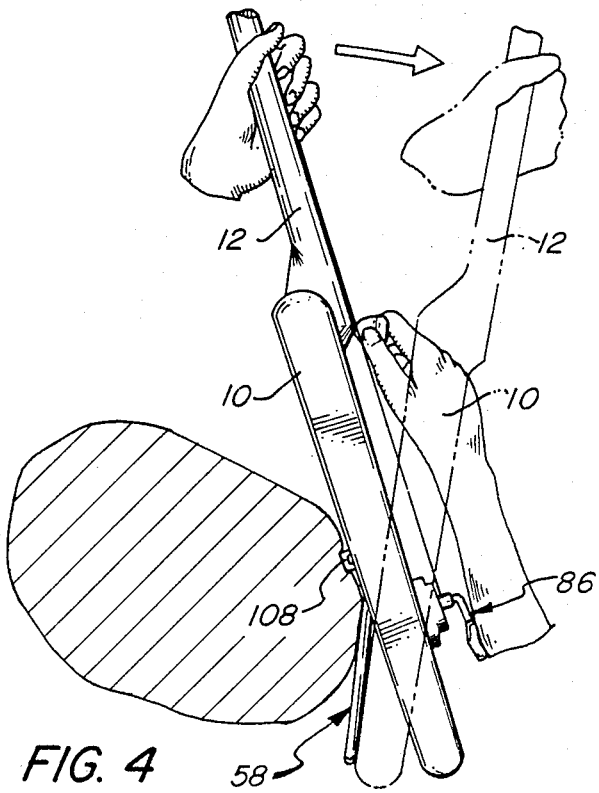
FIG. 4 is a sectional view, taken along line 4—4 of FIG. 3 and drawn to an enlarged scale, showing in full and phantom line two different positions of the instrument with respect to the player's body, the movement therebetween effecting pitch changes by operation of the incorporated assembly.

As best seen in FIG. 4, the arm 72 of the operating lever 58 will typically rest upon the hip of the performer, so that movement of the instrument relative thereto (as suggested by the phantom line representation of the Figure) will urge the lever 58 toward the guitar body, thereby tilting the bridge block body 24 forwardly (i.e., toward the head) and, in turn, reducing the tension on the strings 18. From the same Figure, it will be noted that the player's hand may be positioned with his forearm resting upon the handle portion 102 of the positioning arm 86, so that inward force exerted by his arm will force the bridge block body 24 in the opposite direction (i.e., rearwardly, or toward the tail of the instrument), thereby increasing the tension on the strings and consequently raising their pitch.

With the positioning lever 86 rotated in the opposite direction (as shown in phantom line in FIG. 5), the arm 72 of the operating lever 58 will lie flush against the rear face of the instrument body, and will thereby be rendered inoperative. In this position, the lever 86 will also be constrained against movement toward the body, although movement away from it will not be inhibited; rotating the positioning arm to a lesser (but still forwardly disposed) orientation will enable it to be used for producing both higher and also lower pitch variations. The bar 48 is, as noted above, conventionally used for producing a tremolo effect, and will serve that purpose on the instrument illustrated, particularly when the lever 86 is directed rearwardly. It is also to be noted that the positioning lever 86 is disposed adjacent the bass E-string whereas, as mentioned above, the conventional tremolo bar 48 is on the treble E-string side. This greatly extends the range of musical effects that can be produced, since it allows tremolo action with a hand position which, although physically close to the norm, is vastly different from the musician's standpoint. For example, it enables a hand tremolo effect to be produced virtually simultaneously with picking or strumming of the strings (e.g., by hooking the little finger around the handle 102), a capability which, to the inventor's knowledge, has not heretofore been possible as a practical matter. Thus, the provision of a lever that is so attached to the bridge as to be disposed adjacent the bass E-string is regarded to constitute a unique and highly advantageous feature of the present invention.

The orientation of the arm 72 of the lever 58 relative to the instrument body, in the operative position shown in FIG. 5, is most important to note. The arm 72 penetrates the plane of the rear surface 106 at approximately the intersection of that plane with a perpendicular plane taken through the line of pivoting of the bridge block, i.e., the plane projected transversely through the instrument body from the centerlines of the lugs 32, and designated "a" in FIG. 5. With the player's body seated in the crotch formed between the arm 72 and the instrument body surface 106 (see FIG. 4), contact force will resolve generally along an axis "b", projected therefrom. Because this intersection lies at least approximately on the axis of pivoting of the bridge block, little or no moment of force to induce such pivoting will exist, and a highly stable condition will be afforded, discouraging inadvertent pitch changes done to the weight of the instrument resting upon the player's body; indeed, if any higher levels of force applied to the instrument are balanced so as to be resolved at the intersection discussed, still no pivoting of the bridge block will be produced.

As seen in FIGS. 2 and 4, a locating bumper or feeler 108 may be secured across the rear surface 106 of the instrument body. It will desirably take the form of a tubular element of foam rubber, having end portions (cut longitudinally to semicircular form) wrapped about the edges of the cover plate 110 and secured by two of the fasteners that normally hold the plate in place. Such a bumper provides a tactile reference element which enables the performer to optimally locate the instrument with respect to his body, for operation of the rear lever 58. Being made of a compressible material, the bumper will readily deform so as to impose no constraint upon the desired action, and to offer no discomfort to the player.

Figure 7:
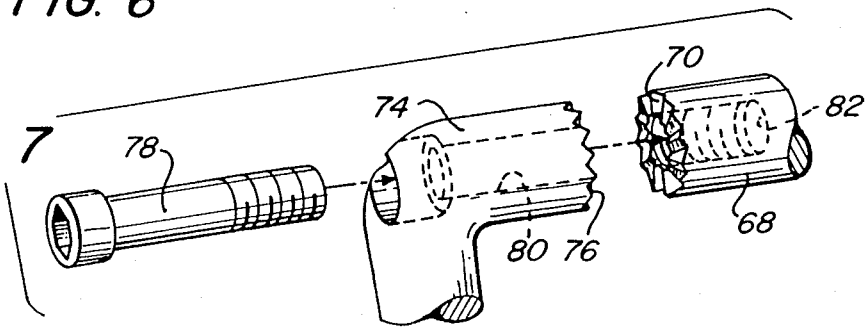
FIG. 7 is a fragmentary, exploded perspective view showing mating elements of a section of the rear operating lever, drawn to a greatly enlarged scale.

Although, in the illustrated embodiment, the positioning lever 86 is moved through an arc of 180° so as to effect pivoting of the operating arm 72 through an angle of approximately 30°, these ratios may be varied, as desired. Thus, for quicker response the full extension of the operating arm 72 may be achieved by movement of the positioning arm through an arc of only, for example, 30°. Conversely, it may be desirable to require a full 360° rotation of the control lever to achieve extension and retraction of the operating arm. In this regard, it is to be appreciated that the amount of rotation of the positioning lever, entailed in extending the operating arm, will determine the disposition of the arm 90, and hence the effect that force on the handle 102 will have upon pitch. For example, pressure (inward force) may either loosen or tighten the strings, depending upon whether the arm of the positioning lever is disposed forwardly or rearwardly of a line through its pivot point, parallel to the axis of pivoting of the bridge block; the same is of course conversely true when lifting force is applied. The degree of extension of the operating arm 72, in its operative condition (i.e., its angular attitude, with respect to the rear face of the instrument body) may of course also vary, depending upon preference. Typically, that angle will be 30° to 90° and, as discussed above, adjustability of the attitude of the arm may be afforded by virtue of the meshing teeth arrangement illustrated in FIG. 7.

Although a separate positioning lever 86 has been illustrated for jacking the operating lever 58, this need not be the case, and in fact the standard tremolo bar 48 could be employed for that purpose, provided of course that appropriate means is incorporated for coupling it to the operating lever. Indeed, although the lever and worm gear arrangement illustrated is presently regarded to be the preferred mode for carrying out the invention, it may be that other mechanisms will serve equally as well, and should be regarded to be encompassed by the appended claims. For example, a slider-like device, accessible from the front of the instrument, might be substituted for the lever 86, with appropriate gearing or other connections being made, as would be evident to those skilled in the art. It is of course important that any mechanism employed be capable not only of changing the position of the operating lever, but also of securing it in the selected orientation.

Thus, it can be seen that the present invention provides a novel mechanism for a pivotable musical instrument bridge block, in which a rear-mounted lever, used for pivoting of the block, can be moved between relatively operative and inoperative positions, by manipulation of positioning means accessible at the front of the instrument, which may be a lever disposed near the edge of the instrument that is upwardly disposed in playing position. The invention also provides a bridge block assembly, and a musical instrument, incorporating such a mechanism, and the means provided for coupling the operating lever to the positioning means is particularly adapted for permitting rapid extension and retraction of the operating arm while, at the same time, positively affixing the arm in any selected position throughout its range of movement. The operating lever for the pivotable block may be so constructed and mounted that the instrument can be rested upon the performer's body without causing inadvertent changers of string pitch, and the operating arm may itself be capable of attitude adjustment. Finally, the mechanism and assembly provided are of relatively simple and inexpensive construction, and may readily be fitted to a musical instrument either as original equipment or as an add-on feature, for after-market installation.

Having thus described the invention, what is claimed is:

1. A bridge block assembly for a musical instrument, comprising:

a bridge block having opposite end portions and having means thereon adapted to pivotally mount said block on a musical instrument body to enable angular shifting of said opposite end portions relative to the instrument body, one of said end portions having means thereon for attaching at least one string;

a first lever having means mounting it on said bridge block, proximate said one end portion, for effecting pivotal movement of said bridge block and for movement of said first lever, relative to said bridge block, between first and second positions;

a second lever having means mounting it on said bridge block, proximate said opposite end portion thereof, for effecting pivotal movement of said bridge block, and for movement of said second lever, relative to said bridge block, between first and second positions; and coupling means operatively interconnecting said first and second levers for effecting movement of said second lever between said positions thereof by movement of said first lever between said positions thereof.

2. The assembly of claim 1 wherein said first lever comprises a portion mounted on said bridge block for pivotal movement on a first axis extending between said end portions thereof, providing said means for mounting said first lever, and an operating portion disposed outwardly of said one end portion of said block; and wherein said second lever comprises a portion mounted on said bridge block for pivotal movement on a second axis oriented transversely to said first axis, providing said means for mounting said second lever, and an operating portion disposed outwardly of said opposite end portion of said block, said operating portion of said second lever being disposed further from said bridge block in said second position than in said first position thereof.

3. The assembly of claim 2 wherein said coupling means comprises a worm gear, including a worm and wheel attached, respectively, to said first and second levers.

4. The assembly of claim 3 wherein: said mounted portion of said first lever comprises a shaft element having said worm attached thereto, said operating portion of said first lever comprises an arm element extending laterally from said shaft element, said mounted portion of said second lever comprises a shaft element extending along said second axis and having said wheel of said worm gear attached thereto, and said operating portion of said second lever comprises an arm element, said arm element of said first lever being movable between said first and second positions to thereby pivot said shaft element thereof through a first angle having a value of 30° to 360°, the worm:wheel turning ratio of said worm gear being such that said first and second positions of said arm element of said second lever thereby attained are displaced from one another by a second angle having a value of 30° to 90°.

5. The assembly of claim 4 wherein said first and second angle values are about 180° and 30°, respectively.

6. The assembly of claim 1 wherein said mounted portion of said first lever comprises a shaft element pivotably mounted on said bridge block, and wherein said operating portion thereof comprises an arm element extending laterally from said shaft element.

7. The assembly of claim 1 wherein said mounted portion of said second lever comprises a pivotably mounted shaft element extending along said second axis, and wherein said operating portion thereof comprises an arm element, said shaft and arm elements of said second lever being disposed, or adapted to be disposed, in parallel planes that intersect one another at an acute angle.

8. The assembly of claim 7 wherein said shaft and arm elements of said second lever are joined to one another through a generally L-shaped section comprised of a first leg extending from said shaft element in a direction away from said first axis, and a second leg extending between said first leg and said arm element along a third axis generally parallel to said second axis.

9. The assembly of claim 8 wherein said second leg is comprised of two elements, interengageable with one another in a multiplicity of relative angular orientations on said third axis.

10. The assembly of claim 8 wherein said means for pivotally mounting defines the axis of pivoting for said bridge block, and wherein said second and third axes are generally parallel to said axis of pivoting, the plane in which said axis of pivoting lies intersection, at a location between said second and third axes, the common plane in which they lie when projected normal thereto.

11. A mechanism for pivoting a musical instrument bridge block having opposite end portions, for producing dynamic variations in pitch of at least one string attached to one of the end portions of the block, comprising:

positioning means having means for mounting it on a pivotable bridge block for movement relative thereto between first and second positions;

a lever having means for mounting it on a pivotable bridge block for effecting pivotal movement thereof, and for movement of said lever relative thereto between first and second positions; and coupling means operatively interconnecting said positioning means and said lever, with said positioning means and lever oppositely disposed, for effecting movement of said lever between said positions thereof by movement of said positioning means between said positions thereof.

12. The mechanism of claim 11 wherein said positioning means is a first lever and said first-mentioned lever is a second lever, wherein said mounting means of both said first lever and said second lever comprises shaft elements, and wherein said first lever includes an arm element extending laterally from said shaft element thereof, and said second lever includes an operating arm element attached to said shaft element thereof.

13. The mechanism of claim 12 wherein said arm element of said first lever is adapted to seat a portion of a player's hand or arm, and wherein said operating arm element is adapted to conform generally to contours of the human body trunk.

14. The mechanism of claim 12 wherein said shaft and arm elements of said second lever are joined to one another through a generally L-shaped section comprised of a first leg extending perpendicularly from said shaft element, and a second leg extending between said first leg and said arm along an axis generally parallel to the axis of said shaft element.

15. The mechanism of claim 12 wherein said coupling means comprises a worm gear, the worm and wheel thereof being attached to said shaft elements of said first and second levers, respectively.

16. A mechanism for pivoting a musical instrument bridge block having opposite end portions, for producing dynamic variations in pitch of at least one string attached to one of the end portions of the block, comprising:

a first lever having means for mounting it on a pivotable bridge block for effecting pivotal movement thereof, and for movement of said first lever relative thereto between first and second positions;

a second lever having means for mounting it on a pivotable bridge block for effecting pivotal movement thereof, and for movement of said second lever relative thereto between first and second positions; and coupling means operatively interconnecting said first and second levers, with said levers oppositely disposed, for effecting movement of said second lever between said positions thereof by movement of said first lever between said positions thereof, said coupling means comprising a worm gear, the worm and wheel of which are attached, respectively to said first and second levers.

17. The mechanism of claim 16 wherein the worm:-wheel turning ratio of said worm gear is such that pivoting of said first lever through a first angle having a value of 30° to 360° will effect pivoting of said shaft element of said second lever, and thereby effect displacement of said operating arm element through a second angle having a value of 30° to 90°.

18. A stringed musical instrument, such as an electric guitar, capable of dynamic variation of string pitch, comprising:

a musical instrument body having front and rear faces, and adapted for attachment of the upper ends of a multiplicity of sound-producing strings to extend parallel to a longitudinal axis of said body and over said front face thereof;

bridge means on said body having means thereon for attaching the lower ends of the strings, said bridge means including a block mounted for pivotal movement about a first axis transverse to said longitudinal axis and having means thereon for attaching the lower end of at least one string;

an operating arm adapted to conform generally to contours of the human body trunk; and mounting means attaching said operating arm to said block at a location offset from a plane, taken transversely through said body, in which said first axis lies, so that force applied at said location in a plane parallel to said transverse plane would tend to pivot said block, said mounting means disposing said arm, in operating position, at an acute angle to and passing through the plane of said rear face of said instrument body and with portions extending inwardly and outwardly thereof, the point of intersection of said arm with said plane of said rear face lying generally in said transverse plane behind said first axis, said mounting means so constraining said arm and block against relative movement as to permit pivoting of said block about said first axis by shifting said arm with respect to said instrument body; whereby, with a trunk part of the player's body seated in the crotch formed between said instrument body and said operating arm, in the region of said intersection, the player may produce string pitch variation by relative movement of his body and said instrument, so as to shift said arm and thereby cause said bridge block to pivot about said first axis to change the tension in a string attached thereto, and whereby force applied by the player's body, so seated, in a direction generally normal to said rear face, will not tend to cause pivoting of said block.

19. The instrument of claim 18 wherein said bridge block extends through said instrument body and has an outer portion disposed substantially on said front face thereof and an inner portion disposed substantially on said rear face thereof, and wherein said mounting means comprises a worm gear, the wheel of said worm gear being rotatably mounted on an axis disposed at said offset location.

20. A stringed musical instrument, such as an electric guitar, capable of dynamic variation of string pitch, comprising:

a musical instrument body having front and rear faces, and adapted for attachment of the upper ends of a multiplicity of sound-producing strings to extend parallel to a longitudinal axis of said body and over said front face thereof;

bridge means on said body having means thereon for attaching the lower ends of the strings, said bridge means including a block having opposite end portions and mounted for pivotal movement about a first axis transverse to said longitudinal axis, said block having means on one end portion for attaching the lower end of at least one string;

a first lever having means mounting it on said bridge block for effecting pivotal movement thereof, and for movement of said first lever relative to said bridge block between first and second positions;

a second lever having means mounting it on said bridge block for effecting pivotal movement thereof, and for movement of said second lever relative to said bridge block between first and second positions, said lever including an operating arm adapted to conform generally to contours of the human body trunk; and coupling means operatively interconnecting said first and second levers, with said levers disposed respectively proximate the opposite end portions of said bridge block, for effecting movement of said second lever between said positions thereof by movement of said first lever between said positions thereof;

said mounting means of said second lever disposing said operating arm at a location offset from a plane, taken transversely through said instrument body, in which said first axis lies, so that force applied at said location in a plane parallel to said transverse plane would tend to pivot said block, said mounting means also disposing said arm, in operating position, at an acute angle to and passing through the plane of said rear face of said instrument body and with portions extending inwardly and outwardly thereof, the point of intersection of said arm with said plane of said rear face lying generally in said transverse plane behind said first axis, said mounting means so constraining said arm and block against relative movement as to permit pivoting of said block about said first axis by shifting said arm with respect to said instrument body; whereby, with a trunk part of the player's body seated in the crotch formed between said instrument body and said operating arm, in the region of said intersection, the player may produce string pitch variation by relative movement of his body and said instrument, so as to shift said arm and thereby cause said bridge block to pivot about said first axis to change the tension in a string attached thereto, and whereby force applied by the player's body, so seated, in a direction generally normal to said rear face, will not tend to cause pivoting of said block.

21. The instrument of claim 20 wherein said bridge means additionally includes a third lever proximate said one end portion of said bridge block for effecting pivotal movement thereof.

22. The instrument of claim 20 wherein said mounting means of both said first lever and said second lever comprises shaft elements, wherein said first lever includes an arm element extending laterally from said shaft element thereof, wherein said coupling means comprises a worm gear, the worm and wheel thereof being attached to said shaft elements of said first and second levers, respectively, and having a worm:wheel turning ratio such that pivoting of said first lever through a first angle having a value of 30° to 360° will effect pivoting of said shaft element of said second lever, and thereby effect displacement of said operating arm element through a second angle having a value of 30° to 90°, said operating arm being disposed against said rear face of said instrument body in said first position thereof.

23. A stringed musical instrument, such as an electric guitar, capable of dynamic variation of string pitch, comprising:

a musical instrument body having front and rear faces, and adapted for attachment of the upper ends of a multiplicity of sound-producing strings to extend parallel to a longitudinal axis of said body and over said front face thereof;

bridge means on said body having means thereon for attaching the lower ends of the strings, said bridge means including a block having opposite end portions and mounted for pivotal movement about a first axis transverse to said longitudinal axis, said block having means on one end portion for attaching the lower end of at least one string;

a lever having means mounting it on said bridge block for effecting pivotal movement thereof, and for movement of said lever relative to said bridge block between first and second positions, said lever including an operating arm disposed to the rear of said instrument body and adapted to conform generally to contours of the human body trunk, said operating arm being extended further from said rear face in said second position of said lever than in said first position thereof; and positioning means, accessible from the front of said instrument body, for effecting movement of said lever between said positions thereof, by manipulation of said positioning means.

24. The instrument of claim 23 wherein an element of compressible material is attached to said instrument body to project outwardly from said rear face thereof at a position spaced upwardly on said body from the location from which said operating arm projects, in said second position thereof.

25. The instrument of claim 24 wherein said element is of generally tubular form, and is disposed laterally thereof proximate the opposite end portion of said bridge block.

26. The instrument of claim 23 wherein said instrument body has opposite side edges transverse to which said first axis extends, and has means thereon for suspending said body in playing position along the performer's body with one of said side edges upwardly disposed, wherein said block of said bridge means extends along said first axis and traverses said longitudinal axis, and wherein said positioning means comprises a second lever having means mounting it on said bridge block, for effecting pivotal movement thereof, at a location intermediate said longitudinal axis and said one side edge of said body.

* * * * *